US009851176B2

(12) United States Patent
Flagler

(10) Patent No.: US 9,851,176 B2
(45) Date of Patent: Dec. 26, 2017

(54) RAIL-MOUNTED FIREARM HANDGRIP ASSEMBLY

(71) Applicant: Tactical Assault Grips, LLC, Ponte Vedra Beach, FL (US)

(72) Inventor: Gary John Flagler, Neptune Beach, FL (US)

(73) Assignee: TACTICAL ASSAULT GRIPS, LLC, Ponte Vedra Beach, FL (US)

( * ) Notice: Subject to any disclaimer, the term of this patent is extended or adjusted under 35 U.S.C. 154(b) by 0 days.

(21) Appl. No.: 15/420,381

(22) Filed: Jan. 31, 2017

(65) Prior Publication Data

US 2017/0234646 A1 Aug. 17, 2017

Related U.S. Application Data

(60) Provisional application No. 62/388,540, filed on Feb. 1, 2016.

(51) Int. Cl.
*F41C 23/16* (2006.01)

(52) U.S. Cl.
CPC ..... *F41C 23/16* (2013.01)

(58) Field of Classification Search
CPC ..... F41C 23/00; F41C 23/12; F41C 23/16; F41C 23/18
See application file for complete search history.

(56) References Cited

U.S. PATENT DOCUMENTS 6,609,321 B2 8/2003 Faifer
6,725,594 B2 * 4/2004 Hines ..... F41A 35/02 42/124
6,782,652 B1 8/2004 Erickson
6,839,990 B2 1/2005 Shiloni
7,216,451 B1 5/2007 Troy
7,523,580 B1 * 4/2009 Tankersley ..... F41C 23/16 42/71.01
7,640,689 B2 1/2010 Fluhr
D639,376 S * 6/2011 Ding ..... D22/108
8,438,769 B1 * 5/2013 Ghannam ..... F41G 11/003 16/430
8,522,467 B1 * 9/2013 Christensen ..... F41C 23/16 42/71.01
8,528,246 B2 9/2013 Telles
8,590,201 B2 * 11/2013 Brixius ..... F41C 23/12 42/71.01
8,650,793 B1 * 2/2014 Mendez ..... F41G 11/003 42/90
8,707,604 B2 * 4/2014 Troy ..... F41A 23/10 248/169
8,726,558 B1 5/2014 Nason
8,776,420 B2 7/2014 Langevin et al.
RE45,185 E 10/2014 Davies
8,875,434 B2 * 11/2014 Michal ..... F41C 23/16 42/90
8,959,820 B2 2/2015 Larson, Jr.
D729,337 S * 5/2015 Boone ..... D22/108
(Continued)

*Primary Examiner* — Derrick R Morgan
(74) *Attorney, Agent, or Firm* — Thomas C. Saitta

(57) ABSTRACT

A handgrip assembly for long-barreled firearms, the assembly having a generally C-shaped in cross-section handgrip, at least one channel recess and mounting clips received within the channel recess, the mounting clips affixing the handgrip to a rail, which may be part of the assembly or be a structural element present on the firearm.

17 Claims, 8 Drawing Sheets

(56) References Cited

U.S. PATENT DOCUMENTS 9,134,092 B2 9/2015 Spiegelhauer
9,279,632 B2 3/2016 Hochstrate et al.
9,453,703 B2 9/2016 Michal et al.
9,464,865 B2 * 10/2016 Shea ..... F41C 23/16
2003/0106251 A1 * 6/2003 Kim ..... F41G 11/003 42/71.01
2005/0268513 A1 * 12/2005 Battaglia ..... F41C 23/16 42/71.01
2008/0190002 A1 * 8/2008 Hines ..... F41G 11/003 42/1.06
2009/0241397 A1 * 10/2009 Fitzpatrick ..... F41C 23/16 42/90
2011/0179688 A1 * 7/2011 Ash, Jr. ..... F41C 23/16 42/72
2012/0005930 A1 * 1/2012 Cragg ..... F41A 11/02 42/1.06
2012/0057360 A1 * 3/2012 Swan ..... A42B 3/04 362/389
2012/0266514 A1 * 10/2012 Michal ..... F41C 23/16 42/90
2014/0013642 A1 * 1/2014 Larson, Jr. ..... F41C 23/16 42/71.01
2014/0215888 A1 * 8/2014 Barber ..... F41A 23/14 42/94
2015/0075054 A1 * 3/2015 Barger ..... F41G 11/003 42/90
2015/0096215 A1 * 4/2015 Somogy ..... F41C 23/16 42/71.01
2015/0233668 A1 * 8/2015 Moore ..... F41C 23/16 42/72
2015/0345896 A1 * 12/2015 Michal ..... F41C 23/16 42/75.01
2016/0076846 A1 * 3/2016 Melancon ..... F41A 23/16 42/94
2016/0223286 A1 * 8/2016 Storch ..... F41C 23/16
2016/0245616 A1 * 8/2016 Derousse ..... F41C 23/16
2016/0290760 A1 * 10/2016 Jen ..... F41C 23/16
2016/0298925 A1 * 10/2016 Gottzmann ..... F41G 11/003
2017/0160048 A1 * 6/2017 Galletta, II ..... F41C 23/16

* cited by examiner

RAIL-MOUNTED FIREARM HANDGRIP ASSEMBLY

This application claims the benefit of U.S. Provisional Patent Application Ser. No. 62/388,540, filed Feb. 1, 2016, the disclosure of which is incorporated herein by reference.

BACKGROUND OF THE INVENTION

This invention relates generally to the field of handgrips utilized on firearms, and more particularly to handgrips on long-barreled firearms, and even more particularly to handgrips mounted onto long-barreled firearms having elongated handguards equipped with or adapted to receive rails for the attachment of accessories to the firearm.

Long-barreled firearms, e.g., rifles, shotguns, tactical assault weapons, etc., typically require the user to position one hand along the forward portion of the firearm for control and aiming purposes. In some instances, the firearm is manufactured with a grip or other body structure suitable for grasping present on the forward portion. For example, with semi-automatic or automatic rifles capable of rapid firing, such as for example AR-15's, the firearms are provided with an elongated handguard, usually generally polygonal or circular in cross-section, that extends over the majority of the forward portion of the firearm. In addition to providing a structure to be gripped by the shooter, the handguard protects the users hand from the heat generated in rapid firing. The handguard also provides a structure to which accessories, such as for example, aiming scopes, laser sights or flashlights, may be mounted.

A common system for mounting accessories to the handguard is to utilize one or more elongated brackets, mounts or platforms, commonly referred to as rails, that are either manufactured as part of the handguard or are subsequently permanently or removably secured to the handguard. The rail is an elongated bracket having a main body with a generally planar outer surface, a pair of parallel, elongated edge members located on opposite sides of the main body, and a plurality of transverse slots disposed in the planar outer surface. As used herein, the term "rail" shall refer to the full bracket, mount or platform structure or member. Thus, the edge members extend parallel to the central axis of the rifle barrel bore and the slots extend in the direction perpendicular to the central axis. For a firearm with a single rail, the rail is typically located along the top of the firearm. Such rails are well known in the art, two examples being the Picatinny rail and the Weaver rail.

The edge members extend from the main body of the rail such that the distance between the edge members is greater than the width of the main body. In transverse cross-section, each rail presents an undercut, inwardly angled, first surface, and typically presents an outwardly facing, inwardly angled, second surface, such that the junction of the first and second surfaces forms an angle. The undercut first surfaces of the rails define the retention surfaces to retain accessories having correspondingly configured channels, whereby the accessories may be slipped onto the rails in the longitudinal direction.

For attachment of accessories or additional rail mounts, some handguards are often provided with a large number of spaced and aligned key slots adapted to receive and retain button tabs located on the interior side of the accessory or rail to be mounted to the firearm, the button tabs being shaped, sized and spaced to correspond to the shape, size and spacing of the key slots. Alternatively, rails may be affixed to the handguards using threaded fasteners driven into threaded apertures provided in the handguard.

The standard handguard structures, while providing basic gripping means and protection from heat, are not optimally designed. For example, the forward hand of the shooter is not provided with a specialized configuration or structure, i.e., a handgrip, to provide a more secure hold on the firearm. Even if a handgrip structure is present in the manufactured firearm, the design suffers from the inability of the shooter to relocate the handgrip forward or rearward along the firearm to account for individual arm length. Additionally, individual shooters may prefer a softer or harder over-mold rubber than that which is provided, or may preferred customized grip configurations. Therefore, to address the problems outlined above, it is an object of this invention provide a handgrip adapted to be mounted onto a rail and a handgrip assembly comprising one or more rails mountable onto the handguard of a firearm. It is a further object to provide a handgrip having an improved outer surface configuration, whereby the one side of the handgrip is configured with multiple angled grooves to accommodate the fingers of the shooter and the other side of the handgrip is configured with an elongated channel to accommodate the thumb of the shooter.

SUMMARY OF THE INVENTION

The rail-mounted firearm handgrip assembly comprises a C-shaped handgrip, C-shaped mounting clamps affixable to a rail when the rail is a permanent construct on the firearm, or the assembly may include one or more rails as an accessory mountable onto the handguard of the firearm. The handgrip comprises a main body and a tactile outer member over-molded, bonded or otherwise affixed to the main body. The tactile outer member is composed of a compressible and flexible polymer material. The main body is preferably composed of a material, such as for example metal, ceramic or a hard polymer, of greater hardness and rigidity than the tactile outer member, which is composed of a material that is more compressible, flexible and possesses a higher coefficient of friction than the main body. Preferably the main body has greater insulative properties than the tactile outer member.

The mounting clamps comprise a central bridging section and two legs, the interior of the combination of the bridging section and the legs defining a mating channel sized so as to receiver and extend around a rail. A threaded aperture is centrally located in the bridging section of the mounting clamp. With a mounting clamp positioned in the channel recess of the main body of the handgrip such that the threaded aperture is aligned with the screw-receiving bore of the main body, a threaded fastener extends through the bore and into the threaded aperture of the mounting clamp, the head of the fastener being of greater diameter than the diameter of the bore such that the fastener cannot pass completely through the bore. With the mounting clamps of the handgrip affixed to the interior of the handgrip by the fasteners, the combination is longitudinally slid onto a rail such that both mounting clamps enclose the rail. As the fasteners are driven farther through the mounting clamps, the end of each fastener strikes the rail, pushing the mounting clamp away from the rail such that the mounting clamp legs are drawn tightly against the rail, thereby securing the handgrip onto the handguard.

In alternative language, the invention in various embodiments is a rail-mounted firearm handgrip assembly comprising a handgrip, said handgrip being C-shaped in transverse cross-section; mounting clamps, said mounting clamps being C-shaped in transverse cross-section; and threaded fasteners, said threaded fasteners disposed to extend through said handgrip so as to affix said mounting clamps to said handgrip; wherein said mounting clamps are adapted to receive a rail located on an elongated handguard of a long-barreled firearm, said handguard having a central axis, and wherein said fasteners affix said mounting clamps to said rail. Furthermore, the assembly wherein each said mounting clamp comprises a bridging section, two legs and a threaded aperture disposed in said bridging section, and wherein said threaded fasteners are disposed so as to pass through said threaded apertures and contact said rail; wherein said handgrip comprises a handgrip main body and a tactile outer member mounted on said handgrip main body; wherein said tactile outer body comprises a thumb groove and finger grooves; wherein said finger grooves are oriented in parallel to each other and comprise tops and bottoms, and wherein said finger groove tops are angled toward the front of said firearm and said finger groove bottoms are angled toward the rear of said firearm when said handgrip is mounted on said firearm; wherein said finger grooves are oriented in parallel to each other and at an angle out of a plane perpendicular to said central axis of said handguard when said handgrip is mounted on said firearm; said handgrip further comprising a channel recess and wherein said mounting clamps are disposed in said channel recess; further comprising said rail located on said handguard; wherein said handgrip main body and said tactile outer member each comprise a first section and a second section, wherein said handgrip main body first section and said tactile outer member first section in combination with said handgrip main body second section and said tactile outer member second section define said C-shaped in transverse cross-section handgrip; further comprising a plurality of rails adapted to be mounted to said handguard, wherein said handgrip further comprises a plurality of channel recess members, and wherein mounting clamps are disposed in each of said plurality of channel recess members; wherein said threaded fasteners, said mounting clamps and said rail are positioned such that advancing said threaded fasteners through said threaded apertures forces said mounting clamps away from said rail such that said legs of said mounting clamps are drawn tightly against said rail; said mounting clamps further comprising a mating channel adapted to receive said rail, and said legs comprising a first surface, wherein with said rail disposed within said mating channel, said leg first surfaces are drawn tightly against said rail; and/or wherein said tactile outer member is composed of a compressible and flexible polymer material, such that said tactile outer member is softer, more compressible and more flexible than the said handgrip main body.

Likewise, a rail-mounted firearm handgrip assembly adapted for mounting onto the handguard of a long-barreled firearm, said assembly comprising a handgrip, said handgrip being C-shaped in transverse cross-section and comprising a handgrip main body and a tactile outer member, said handgrip main body being more rigid than said tactile outer member, said handgrip main body comprising an elongated channel recess; mounting clamps, said mounting clamps being C-shaped in transverse cross-section and comprising a bridging section, two legs and a threaded aperture disposed in said bridging section, wherein said mounting clamps are disposed in said channel recess and are adapted to receive a rail located on an elongated handguard of a long-barreled firearm; and threaded fasteners, wherein said threaded fasteners are disposed to extend through said handgrip so as to affix said mounting clamps to said handgrip and wherein said threaded fasteners are disposed so as to pass through said threaded apertures and contact said rail so as to affix said mounting clamps to said rail, and/or wherein said tactile outer body comprises a thumb groove and finger grooves; further comprising said rail located on said handguard; further comprising a plurality of rails adapted to be mounted to said handguard, wherein said handgrip further comprises a plurality of channel recess members, and wherein mounting clamps are disposed in each of said plurality of channel recess members; wherein said threaded fasteners, said mounting clamps and said rail are positioned such that advancing said threaded fasteners through said threaded apertures forces said mounting clamps away from said rail such that said legs of said mounting clamps are drawn tightly against said rail; said mounting clamps further comprising a mating channel adapted to receive said rail, and said legs comprising a first surface, wherein with said rail disposed within said mating channel, said leg first surfaces are drawn tightly against said rail.

Alternatively still, a rail-mounted firearm handgrip assembly adapted for mounting onto the handguard of a long-barreled firearm, said assembly comprising a handgrip, said handgrip being C-shaped in transverse cross-section and comprising a handgrip main body and a tactile outer member, said handgrip main body being more rigid than said tactile outer member, said handgrip main body comprising one or more elongated channel recesses, said tactile outer body comprising a thumb groove and finger grooves; mounting clamps, said mounting clamps being C-shaped in transverse cross-section and each comprising a mating channel, a bridging section, two legs and threaded apertures disposed in said bridging section, wherein said mounting clamps are disposed in said channel recess; one or more rails adapted to be mounted onto a handguard of a long-barreled firearm, said mounting clamps adapted to receive one of said one or more rails within said mating channel; and threaded fasteners, wherein said threaded fasteners are disposed to extend through said handgrip so as to affix said mounting clamps to said handgrip and wherein said threaded fasteners are disposed so as to pass through said threaded apertures and contact said one or more rails so as to affix said mounting clamps to said one or more rails; wherein said threaded fasteners, said mounting clamps and said one or more rails are positioned such that advancing said threaded fasteners through said threaded apertures forces said mounting clamps away from said one or more rails such that said legs of each of said mounting clamps are drawn tightly against one of said one or more rails.

DETAILED DESCRIPTION OF THE INVENTION

The invention in various embodiments is in general a rail-mounted firearm handgrip assembly, wherein the handgrip is mounted onto one or more rails manufactured into the firearm or the assembly includes one or more rails accessories subsequently attached to the firearm. The firearm is long-barreled weapon, e.g. a rifle or shotgun as opposed to a handgun, and in particular the handgrip assembly is adapted for use on semi-automatic and automatic firearms, such as an AR-15 or similar tactical assault weapons, wherein a major forward portion of the firearm comprises an elongated handguard 40 having a main body 41 generally circular or polygonal, e.g., octagonal, in transverse cross-section. The handguard 40 defines the structure that is held by the shooter and acts an insulating member such that the heat of rapid firing is dissipated and not transferred to the shooter's forward gripping hand. The handguard 40 also acts as a receptacle for the mounting of accessories, such as optical scopes, laser sights, flashlights, etc., the main body 41 being provided with key slot apertures 42 or other mechanical interlocking means for attachment of the accessories to the firearm.

Figure 1:
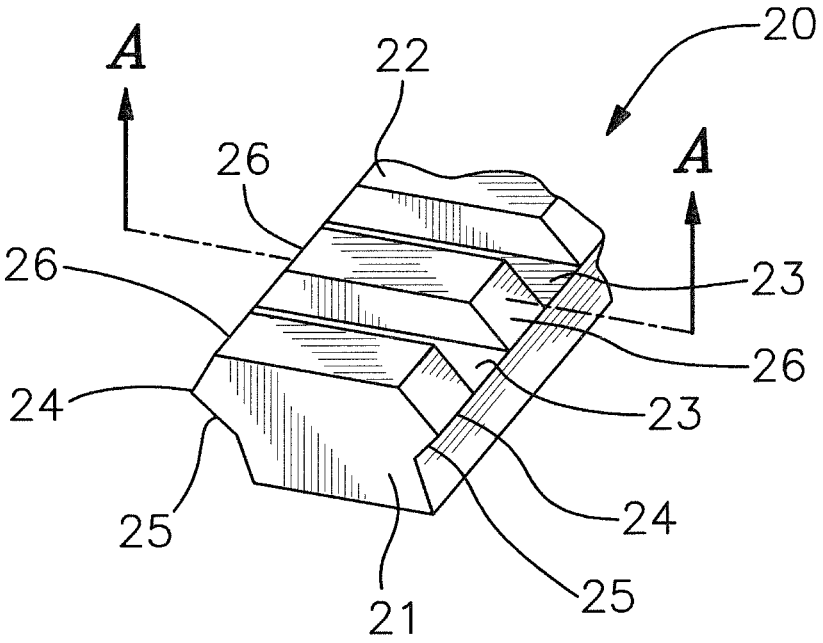
FIG. 1 is a partial perspective view of a representative rail mount.
Figure 2:
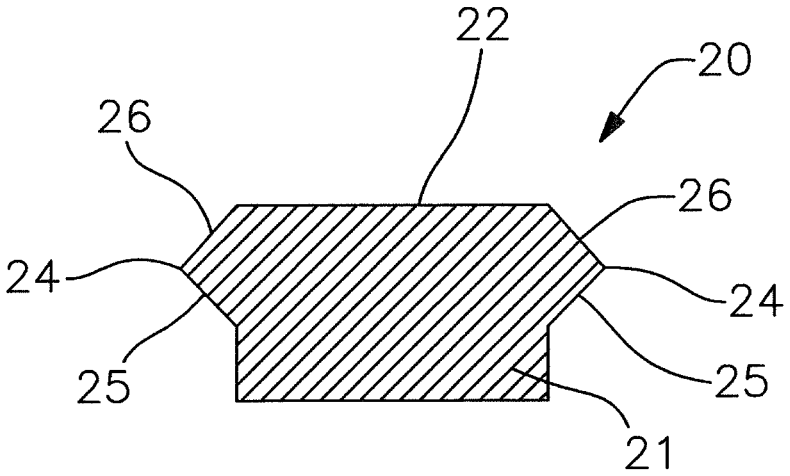
FIG. 2 is a cross-sectional view of the rail mount of FIG. 1 taken along line A-A.
Figure 3:
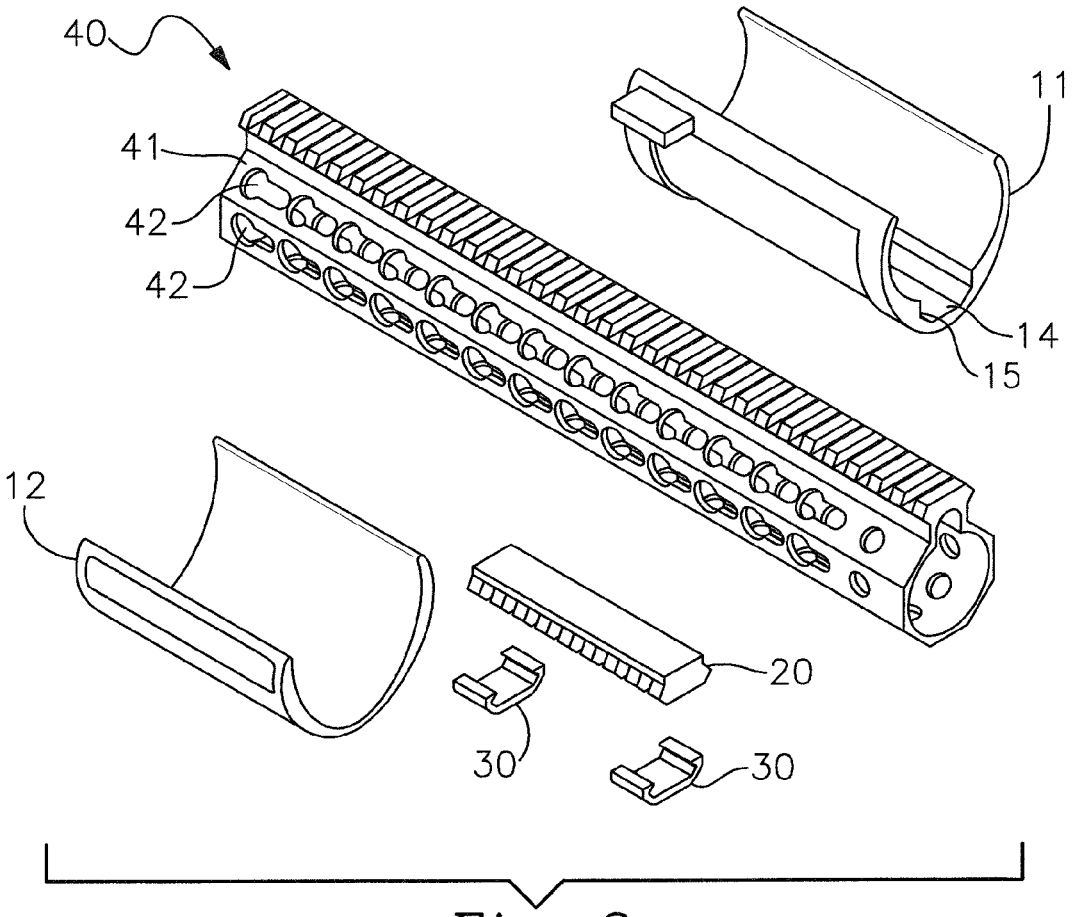
FIG. 3 is an exploded view of an embodiment of the invention assembly.
Figure 4:
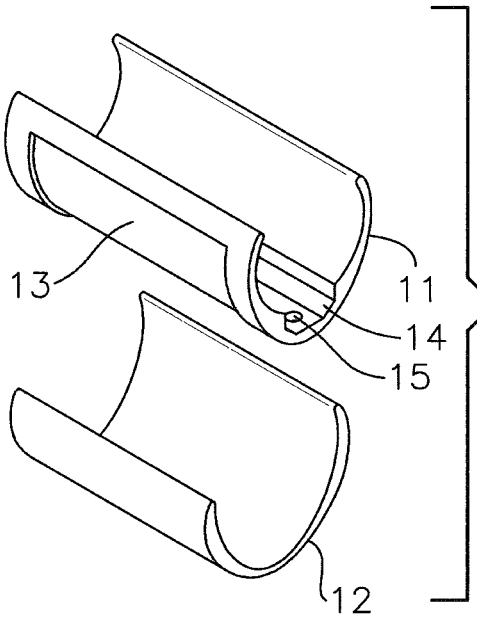
FIG. 4 is an exploded view showing the main body and tactile outer member of the handgrip embodied in FIG. 3.

As shown in FIGS. 1 and 2, a rail 20 is an elongated bracket having a main body 21 with a generally planar outer surface 22, a pair of parallel, elongated edge members 24 extending from opposite sides of the main body 21, and a plurality of transverse slots 23 disposed in the outer surface 22. The edge members 24 extend parallel to the central axis of the handguard 40 or rifle barrel bore and the slots 23 extend in the transverse direction perpendicular to the central axis. For a firearm with a single rail 20, the rail 20 is typically located along the top of the firearm. Other firearms may have two, three or four rails 20.

The edge members 24 extend laterally from the main body 21 of the rail 20 such that the distance between the edge members 24 is greater than the width of the main body 21, thereby presenting a "flattened T" configuration in transverse cross-section, as shown in FIG. 2. Each rail 20 presents an undercut, inwardly angled, first surface 25, and typically presents an outwardly facing, inwardly angled, second surface 26, such that the junction of the first surface 25 and second surface 26 forms an angle. The undercut first surfaces 25 of the rail 20 define the retention surfaces to retain accessories having correspondingly configured channels, whereby the accessories may be slipped onto the rail 20 in the longitudinal direction.

For attachment of accessories or additional rails 20, handguards 40 are often provided with a large number of spaced and aligned key slots 42 adapted to receive and retain button tabs located on the interior side of the accessory or rail 20 to be mounted to the firearm, the button tabs being shaped, sized and spaced to correspond to the shape, size and spacing of the key slots 42. Alternatively, accessory rails 20, i.e., rails 20 not manufactured into the firearm, may be affixed to the handguards 40 using threaded fasteners driven into threaded apertures provided in the handguard 40.

In a first embodiment, as shown in FIGS. 3 through 8, the handgrip assembly comprises a handgrip 10, mounting clamps 30 and a rail 20, the rail being either a permanent construct on the firearm or an accessory mountable onto the handguard of the firearm. The handgrip 10 comprises a substantially C-shaped main body or base member 11 and a tactile outer member 12 over-molded, bonded or otherwise affixed to the main body 11, such as by positioning the tactile outer member 12 in an outer recess 13. The tactile outer member 12 is composed of a compressible and flexible polymer material. Most preferably the tactile outer member 12 is over-molded onto the main body 11. The main body 11 is preferably composed of a material, such as for example metal, ceramic or a hard polymer, of greater hardness and rigidity than the tactile outer member 12, which is composed of a material that is more compressible, flexible and possesses a higher coefficient of friction than the main body 11. Preferably the main body 11 has greater insulative properties than the tactile outer member 12.

Figure 5:
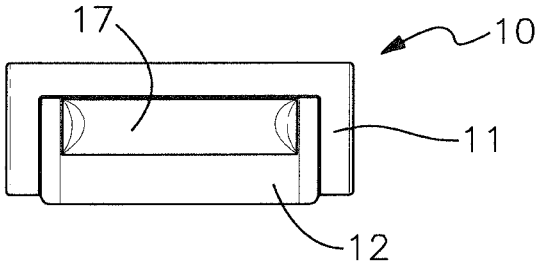
FIG. 5 is a left side view of the handgrip embodied in FIG. 3.
Figure 6:
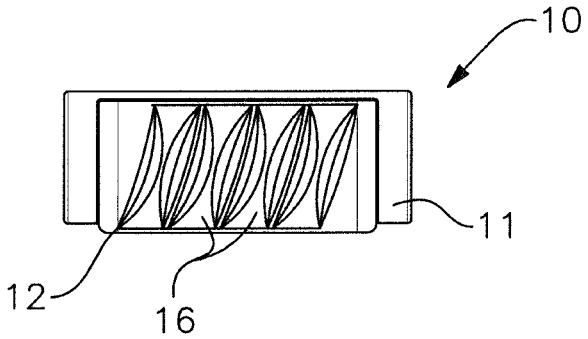
FIG. 6 is a right side view of the handgrip embodied in FIG. 3.
Figure 7:
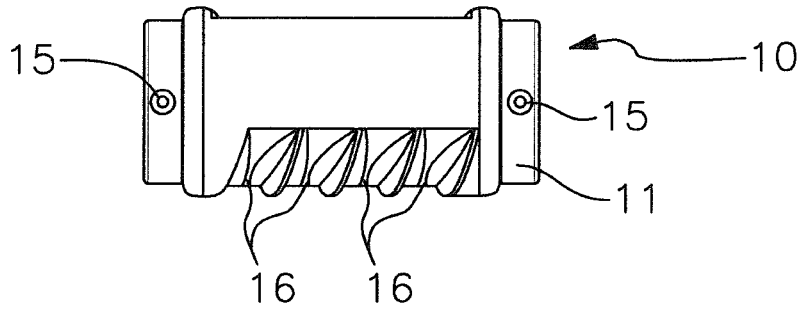
FIG. 7 is a bottom side view of the handgrip embodied in FIG. 3.
Figure 8:
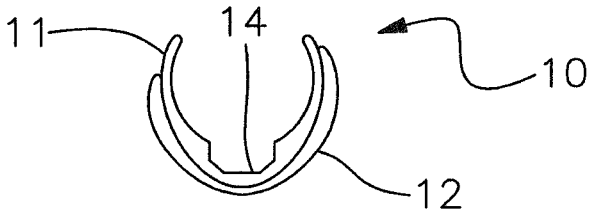
FIG. 8 is an end view of the handgrip embodied in FIG. 3.

The tactile outer member 11 is preferably configured as shown in FIGS. 5, 6 and 7, wherein one side of the tactile outer member 11 is provided with a series of finger grooves or recesses 16, preferably four in number, sized and configured so as to comfortably receive the fingers of the shooter when holding the handgrip 10. The finger grooves 17 may be oriented in parallel to each other and at an angle out of a plane perpendicular to the central axis of the handguard 40 when the handgrip 10 is mounted onto the handguard 40, i.e., the tops of the finger grooves 16 will angle toward the front of the firearm and the bottoms of the finger grooves 16 will angle rearward. The opposite side of the tactile outer member 11 is most preferably provided with a longitudinal thumb groove or recess 17, the thumb groove 17 oriented to be substantially parallel to the central axis of the central axis of the handguard 40 when the handgrip 10 is mounted onto the handguard 40. Alternatively, the finger groves 17 may be oriented perpendicularly to the central axis of the handguard 40. With this construct, the handgrip 10 is reversible to account for whether the shooter is left-handed or right-handed, as the handgrip 10 may be mounted to the handguard 40 with the thumb groove 17 on the left side of the handguard 40 for a shooter using the left hand to support the firearm and may be mounted with the thumb groove 17 on the right side of the handguard 40 for a shooter using the right hand to support the firearm.

The interior of the main body 11 is provided with a channel recess 14 extending the longitudinal length of the handgrip 10. Screw-receiving bores 15 are provided in the main body 11 adjacent each end of the handgrip 10 and passing into the channel recess 14. The dimensions of the channel recess 14 are chosen so as to be able to receive and envelope mounting clamps 30 and at least a portion of a rail 20.

Figure 9:
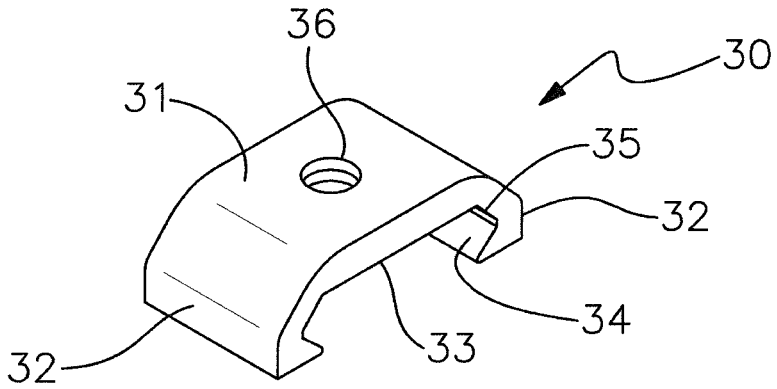
FIG. 9 is a perspective view of the mounting clamp as embodied in FIG. 3.
Figure 10:
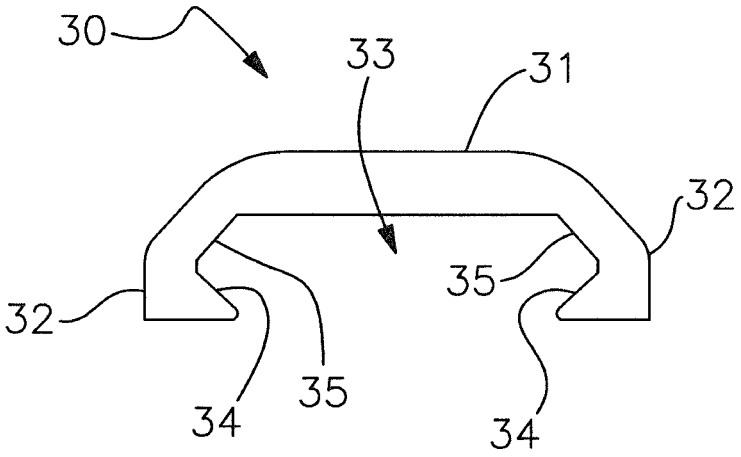
FIG. 10 is an end view of the mounting clamp as embodied in FIG. 3.
Figure 11:
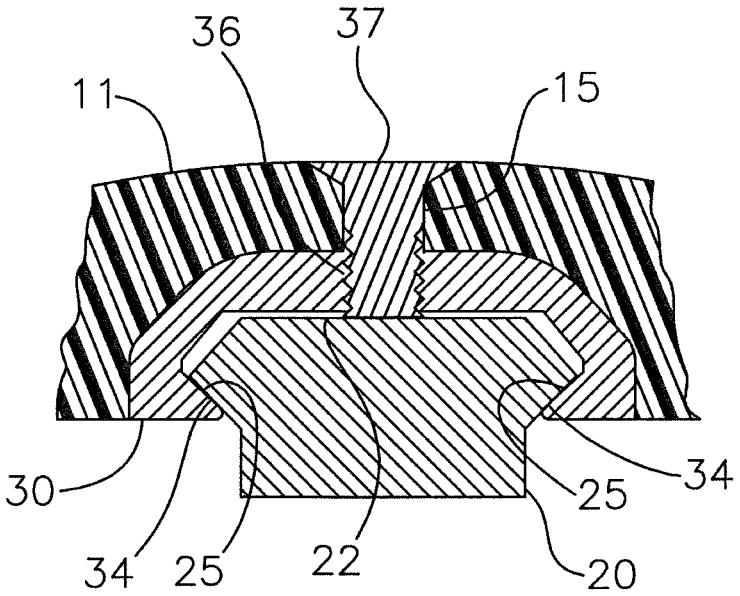
FIG. 11 is a partial cross-sectional view showing the handgrip as affixed to a rail as embodied in FIG. 3.

Mounting clamps 30, as shown in FIGS. 9 and 10, is a generally C-shaped member comprising a central bridging section 31 and two legs 32, the interior of the combination of the bridging section 31 and the legs 32 defining a mating channel 33 sized so as to receiver and extend around a rail 20. The interior of the legs 32 define a first surface 34 and a second surface 35, the first surface 34 angling outward and the second surface 35 angling inward, such that the junction of the planes containing the first surface 34 and the second surface 35 forms an angle. The size and configuration of the mating channel 33 is chosen so as to match the configuration of the rail 20 defined by the rail first surface 25 and the rail second surface 26, but slightly larger such that the mounting clamps 30 will slide onto the rail 20 in the longitudinal direction, as shown in FIG. 11. A threaded aperture 36 is centrally located in the bridging section 31 of the mounting clamp 30. With a mounting clamp 30 positioned in the channel recess 14 of the main body 11 of the handgrip 10 such that the threaded aperture 36 is aligned with the screw-receiving bore 15 of the main body 11, a threaded fastener 37 such as a headed set screw extends through the bore 15 and into the threaded aperture 36 of the mounting clamp 30, the head of the set screw 37 being of greater diameter than the diameter of the bore 15 such that the set screw 37 cannot pass completely through the bore 15.

With the mounting clamps 30 of the handgrip 10 affixed to the interior of the handgrip 10 by set screw 37, the combination is longitudinally slid onto a rail 20 comprising or mounted onto the handguard 40 such that both mounting clamps 30 enclose the rail outer surface 22, rail first surface 25 and rail second surface 26. The handgrip 10 is positioned at the desired location along the handguard 40. As the set screws 37 are driven farther through the mounting clamps 30, the end of each set screw 37 strikes the rail outer surface 22 (or the bottom of one of the transverse slots 23), pushing the mounting clamp 30 away from the rail 20 such that the mounting clamp first surfaces 34 are drawn tightly against the rail first surfaces 25, thereby securing the handgrip 10 onto the handguard 40. The handgrip 10 can be removed by loosening the set screws 37 to free the mounting clamps 30 from the rail 20 and then sliding the handgrip 10 off the rail 20.

Figure 12:
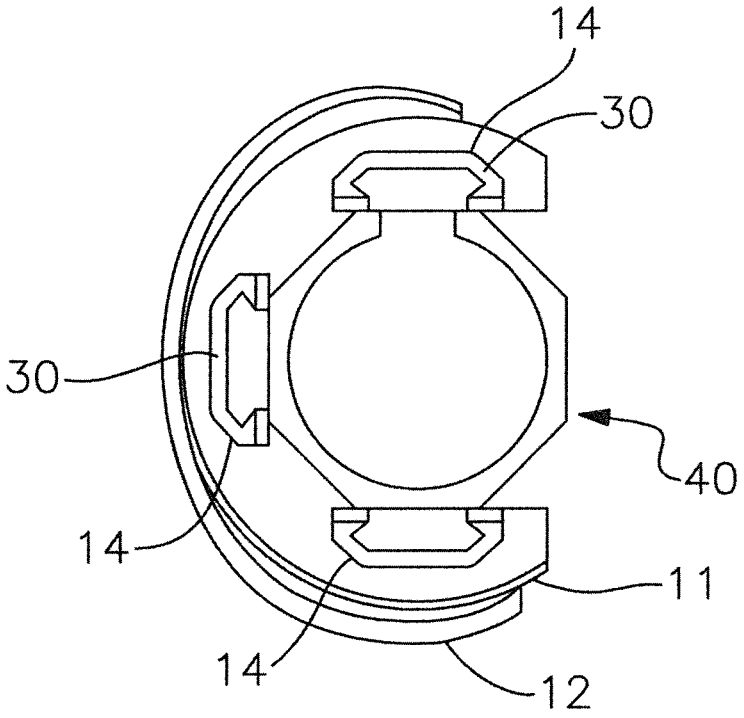
FIG. 12 is an end view of an alternative embodiment for the handgrip as mounted on a handguard utilizing three rails.

In another embodiment shown in FIG. 12, instead of mounting the handgrip 10 onto a single rail 20 such that the sides of the handgrip 10 simply abut the side portions of the handguard 40, a plurality of rails 20, in this illustration a set of three rails 20, may be disposed on the handguard 40. The handgrip main body 11 is provided with three corresponding channel recesses 14 and three sets of mounting clamps 30, such that the center and two side portions of handgrip 10 are each affixed to a rail 20.

Figure 13:
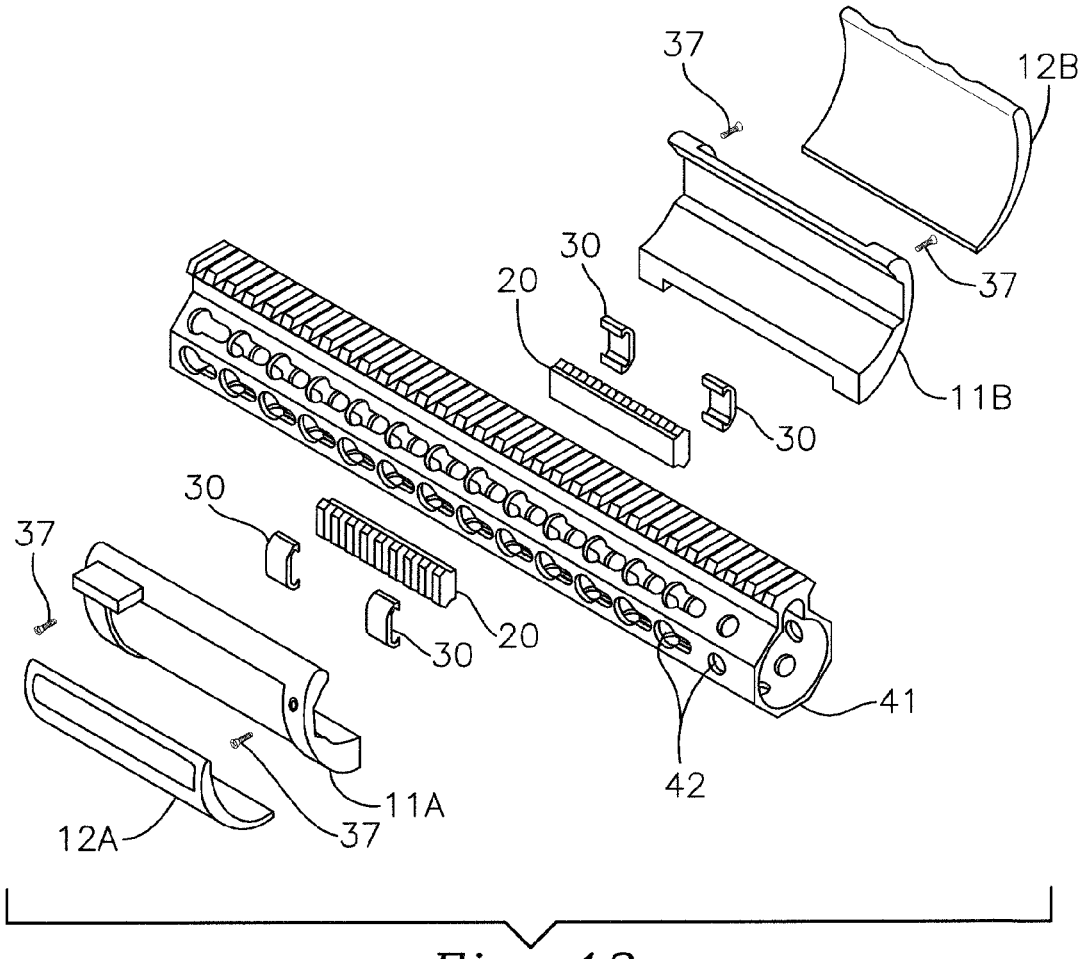
FIG. 13 is an exploded view of an alternative embodiment of the invention assembly showing a split handgrip and the use of two mounting rails.
Figure 14:
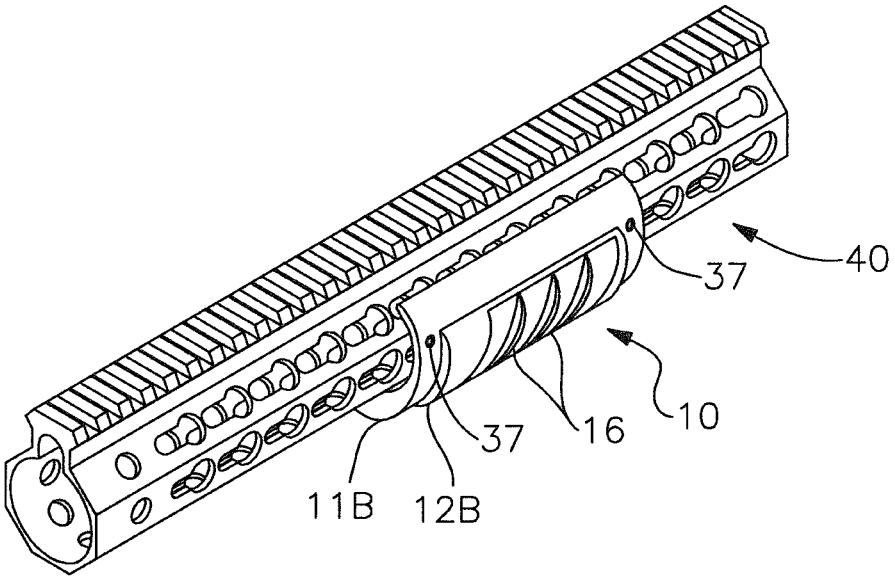
FIG. 14 is a perspective view of the right side of the handgrip as embodied in FIG. 13 mounted onto a handguard.
Figure 15:
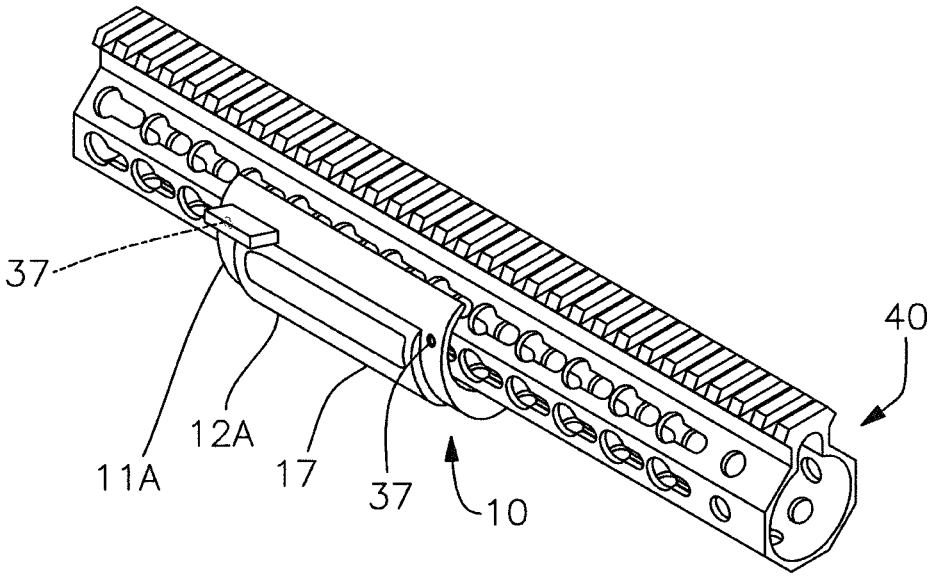
FIG. 15 is a perspective view of the left side of the handgrip as embodied in FIG. 13 mounted onto a handguard.

In still another embodiment, as shown in FIGS. 13 through 15, the handgrip 10 is composed of a main body first section 11A, a main body second section 11B, a tactile outer member 12A and a tactile outer member 12B. Each main body section 11A and 11B is provided with its own channel recess 14 to receive a set of mounting clamps 30. Tactile outer member 12A is provided with a thumb groove 17 and tactile outer member 12B is provided with finger grooves 16. Two rails 20 are utilized, the rails 20 being positioned on opposite sides of the handguard 40. When mounted onto the rails 20 as described above, the main body sections 11A and 11B preferably meet such that the completed handgrip 10 wraps around the handguard 40.

I claim:

1. A rail-mounted firearm handgrip assembly comprising:

a handgrip, said handgrip being C-shaped in transverse cross-section;

mounting clamps, said mounting clamps being C-shaped in transverse cross-section; and threaded fasteners, said threaded fasteners disposed to extend through said handgrip so as to affix said mounting clamps to said handgrip;

wherein said mounting clamps are adapted to receive a rail located on an elongated handguard of a long-barreled firearm, said handguard having a central axis, and wherein said fasteners affix said mounting clamps to said rail;

wherein each said mounting clamp comprises a bridging section, two legs and a threaded aperture disposed in said bridging section, and wherein said threaded fasteners are disposed so as to pass through said threaded apertures and contact said rail; and wherein said threaded fasteners, said mounting clamps and said rail are positioned such that advancing said threaded fasteners through said threaded apertures forces said mounting clamps away from said rail such that said legs of said mounting clamps are drawn tightly against said rail.

2. The assembly of claim 1, wherein said handgrip comprises a handgrip main body and a tactile outer member mounted on said handgrip main body.

3. The assembly of claim 2, wherein said tactile outer body comprises a thumb groove and finger grooves.

4. The assembly of claim 3, wherein said finger grooves are oriented in parallel to each other and comprise tops and bottoms, and wherein said finger groove tops are angled toward the front of said firearm and said finger groove bottoms are angled toward the rear of said firearm when said handgrip is mounted on said firearm.

5. The assembly of claim 3, wherein said finger grooves are oriented in parallel to each other and at an angle out of a plane perpendicular to said central axis of said handguard when said handgrip is mounted on said firearm.

6. The assembly of claim 1, said handgrip further comprising a channel recess and wherein said mounting clamps are disposed in said channel recess.

7. The assembly of claim 1, further comprising said rail located on said handguard.

8. The assembly of claim 2, wherein said handgrip main body and said tactile outer member each comprise a first section and a second section, wherein said handgrip main body first section and said tactile outer member first section in combination with said handgrip main body second section and said tactile outer member second section define said C-shaped in transverse cross-section handgrip.

9. The assembly of claim 1, further comprising a plurality of rails adapted to be mounted to said handguard, wherein said handgrip further comprises a plurality of channel recess members, and wherein mounting clamps are disposed in each of said plurality of channel recess members.

10. The assembly of claim 1, said mounting clamps further comprising a mating channel adapted to receive said rail, and said legs comprising a first surface, wherein with said rail disposed within said mating channel, said leg first surfaces are drawn tightly against said rail.

11. The assembly of claim 2, wherein said tactile outer member is composed of a compressible and flexible polymer material, such that said tactile outer member is softer, more compressible and more flexible than the said handgrip main body.

12. A rail-mounted firearm handgrip assembly adapted for mounting onto the handguard of a long-barreled firearm, said assembly comprising:

a handgrip, said handgrip being C-shaped in transverse cross-section and comprising a handgrip main body and a tactile outer member, said handgrip main body being more rigid than said tactile outer member, said handgrip main body comprising an elongated channel recess;

mounting clamps, said mounting clamps being C-shaped in transverse cross-section and comprising a bridging section, two legs and a threaded aperture disposed in said bridging section, wherein said mounting clamps are disposed in said channel recess and are adapted to receive a rail located on an elongated handguard of a long-barreled firearm;

threaded fasteners, wherein said threaded fasteners are disposed to extend through said handgrip so as to affix said mounting clamps to said handgrip and wherein said threaded fasteners are disposed so as to pass through said threaded apertures and contact said rail so as to affix said mounting clamps to said rail; and wherein said threaded fasteners, said mounting clamps and said rail are positioned such that advancing said threaded fasteners through said threaded apertures forces said mounting clamps away from said rail such that said legs of said mounting clamps are drawn tightly against said rail.

13. The assembly of claim 12, wherein said tactile outer body comprises a thumb groove and finger grooves.

14. The assembly of claim 12, further comprising said rail located on said handguard.

15. The assembly of claim 14, further comprising a plurality of rails adapted to be mounted to said handguard, wherein said handgrip further comprises a plurality of channel recess members, and wherein mounting clamps are disposed in each of said plurality of channel recess members.

16. The assembly of claim 12, said mounting clamps further comprising a mating channel adapted to receive said rail, and said legs comprising a first surface, wherein with said rail disposed within said mating channel, said leg first surfaces are drawn tightly against said rail.

17. A rail-mounted firearm handgrip assembly adapted for mounting onto the handguard of a long-barreled firearm, said assembly comprising:

a handgrip, said handgrip being C-shaped in transverse cross-section and comprising a handgrip main body and a tactile outer member, said handgrip main body being more rigid than said tactile outer member, said handgrip main body comprising one or more elongated channel recesses, said tactile outer body comprising a thumb groove and finger grooves;

mounting clamps, said mounting clamps being C-shaped in transverse cross-section and each comprising a mating channel, a bridging section, two legs and threaded apertures disposed in said bridging section, wherein said mounting clamps are disposed in said channel recess;

one or more rails adapted to be mounted onto a handguard of a long-barreled firearm, said mounting clamps adapted to receive one of said one or more rails within said mating channel; and threaded fasteners, wherein said threaded fasteners are disposed to extend through said handgrip so as to affix said mounting clamps to said handgrip and wherein said threaded fasteners are disposed so as to pass through said threaded apertures and contact said one or more rails so as to affix said mounting clamps to said one or more rails;

wherein said threaded fasteners, said mounting clamps and said one or more rails are positioned such that advancing said threaded fasteners through said threaded apertures forces said mounting clamps away from said one or more rails such that said legs of each of said mounting clamps are drawn tightly against one of said one or more rails.

* * * * *